US010293464B2

(12) United States Patent
Meyer

(10) Patent No.: US 10,293,464 B2
(45) Date of Patent: May 21, 2019

(54) ABRADING DEVICE

(71) Applicant: CORNING INCORPORATED, Corning, NY (US)

(72) Inventor: Timothy Edward Meyer, Pine City, NY (US)

(73) Assignee: CORNING INCORPORATED, Corning, NY (US)

( * ) Notice: Subject to any disclaimer, the term of this patent is extended or adjusted under 35 U.S.C. 154(b) by 351 days.

(21) Appl. No.: 15/147,340

(22) Filed: May 5, 2016

(65) Prior Publication Data

US 2016/0325401 A1 Nov. 10, 2016

Related U.S. Application Data

(60) Provisional application No. 62/156,942, filed on May 5, 2015.

(51) Int. Cl.

| | |
|---|---|
| ***B24C 5/02*** | (2006.01) |
| ***B24C 3/04*** | (2006.01) |
| ***B24C 7/00*** | (2006.01) |
| ***B24B 57/02*** | (2006.01) |
| ***B24B 19/22*** | (2006.01) |
| ***B24C 3/06*** | (2006.01) |

(52) U.S. Cl.

CPC ..... *B24B 57/02* (2013.01); *B24B 19/22* (2013.01); *B24C 3/04* (2013.01); *B24C 3/065* (2013.01); *B24C 5/02* (2013.01); *B24C 7/00* (2013.01); *B24C 7/0046* (2013.01); *B24C 7/0061* (2013.01)

(58) Field of Classification Search

CPC .. B24C 3/065; B24C 3/04; B24C 3/10; B24C 5/02; B24C 5/04; B24C 7/00; B24C 7/0046; B24C 7/0053; B24C 7/0061; B24C 9/00; B24C 9/003

USPC ..... 451/75, 87, 99, 100

See application file for complete search history.

(56) References Cited

U.S. PATENT DOCUMENTS

| | | | | | |
|---|---|---|---|---|---|
| 3,994,097 | A * | 11/1976 | Lamb | B24C 5/02 | 451/40 |
| 4,045,915 | A * | 9/1977 | Gilbert | B24C 3/065 | 15/345 |
| 4,218,855 | A * | 8/1980 | Wemmer | B05B 7/149 | 239/343 |
| 5,054,249 | A * | 10/1991 | Rankin | B24C 7/0053 | 451/101 |
| 5,363,556 | A * | 11/1994 | Banholzer | B24C 1/045 | 164/98 |
| 5,588,901 | A * | 12/1996 | Rubey, III | B08B 7/00 | 134/21 |
| 5,637,030 | A * | 6/1997 | Chopra | B24C 1/045 | 451/39 |
| 6,425,805 | B1 * | 7/2002 | Massa | B24C 5/04 | 239/433 |
| 9,050,704 | B1 * | 6/2015 | Liu | B24C 1/045 | |
| 2002/0169461 | A1 * | 11/2002 | Simon | A61H 9/005 | 606/131 |

(Continued)

*Primary Examiner* — Eileen P Morgan

(74) *Attorney, Agent, or Firm* — Kevin M. Johnson

(57) ABSTRACT

An abrading device includes a funnel and an outlet orifice disposed within the funnel for passage of abrasive material, where a distance between the outlet orifice and a bottom end of the funnel is adjustable. An exhaust tube is coupled to the funnel for withdrawal of spent abrasive material from the funnel.

11 Claims, 6 Drawing Sheets

(56) References Cited

U.S. PATENT DOCUMENTS

| | | | | |
|---|---|---|---|---|
| 2012/0273396 | A1* | 11/2012 | Roden | B07B 1/10 209/235 |
| 2014/0213150 | A1* | 7/2014 | Schubert | B24C 9/00 451/38 |
| 2015/0196989 | A1* | 7/2015 | Hashish | B24C 7/0046 451/40 |

* cited by examiner

ABRADING DEVICE

CROSS-REFERENCE TO RELATED APPLICATIONS

This application claims benefit of priority under 35 U.S.C. § 119 of U.S. Provisional Application No. 62/156,942, filed on 5 May 2015 the content of which is relied upon and incorporated herein by reference in its entirety.

BACKGROUND

To determine the response of a glass or glass-ceramic material to flaws, an abrasion procedure may be used to introduce flaws into the material, followed by mechanical testing of the abraded material. Standard abrasion procedures for glass materials are described in Section A2 of ASTM C158-02 (ASTM Standard C158-02 (2007), "Standard Test Methods for Strength of Glass by Flexure—Determination of Modulus of Rupture, ASTM International," ASTM International, West Conshohocken, Pa., 2007, DOI: 10.1520/C0158-02R07).

SUMMARY

An abrading device that can be used for selective abrasion of specimens, such as glass and glass-ceramic specimens, in preparation for subsequent mechanical testing is disclosed. In one illustrative embodiment, the abrading device includes a funnel. An orifice structure providing an outlet orifice is disposed within the funnel. A position or length of the orifice structure is adjustable within the funnel such that an offset distance of the outlet orifice from a bottom end of the funnel is adjustable. The abrading device further includes a vacuum line connected to the funnel to remove spent abrasion material from the funnel, where the vacuum line has an adjustable vacuum pressure. An illustrative companion method of abrading a specimen includes positioning a specimen at a select distance below the bottom end of the funnel. The method further includes adjusting the offset distance of the outlet orifice from the bottom end of the funnel to set an abrasion distance between the outlet orifice and the specimen to a select value. The method further includes establishing a flow of gas through the funnel and orifice structure. The method further includes dumping an abrasive material into the funnel, where the abrasive material passes through the orifice structure and outlet orifice to strike a select area of the specimen. The method further includes removing spent abrasive material from the funnel through the vacuum line.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
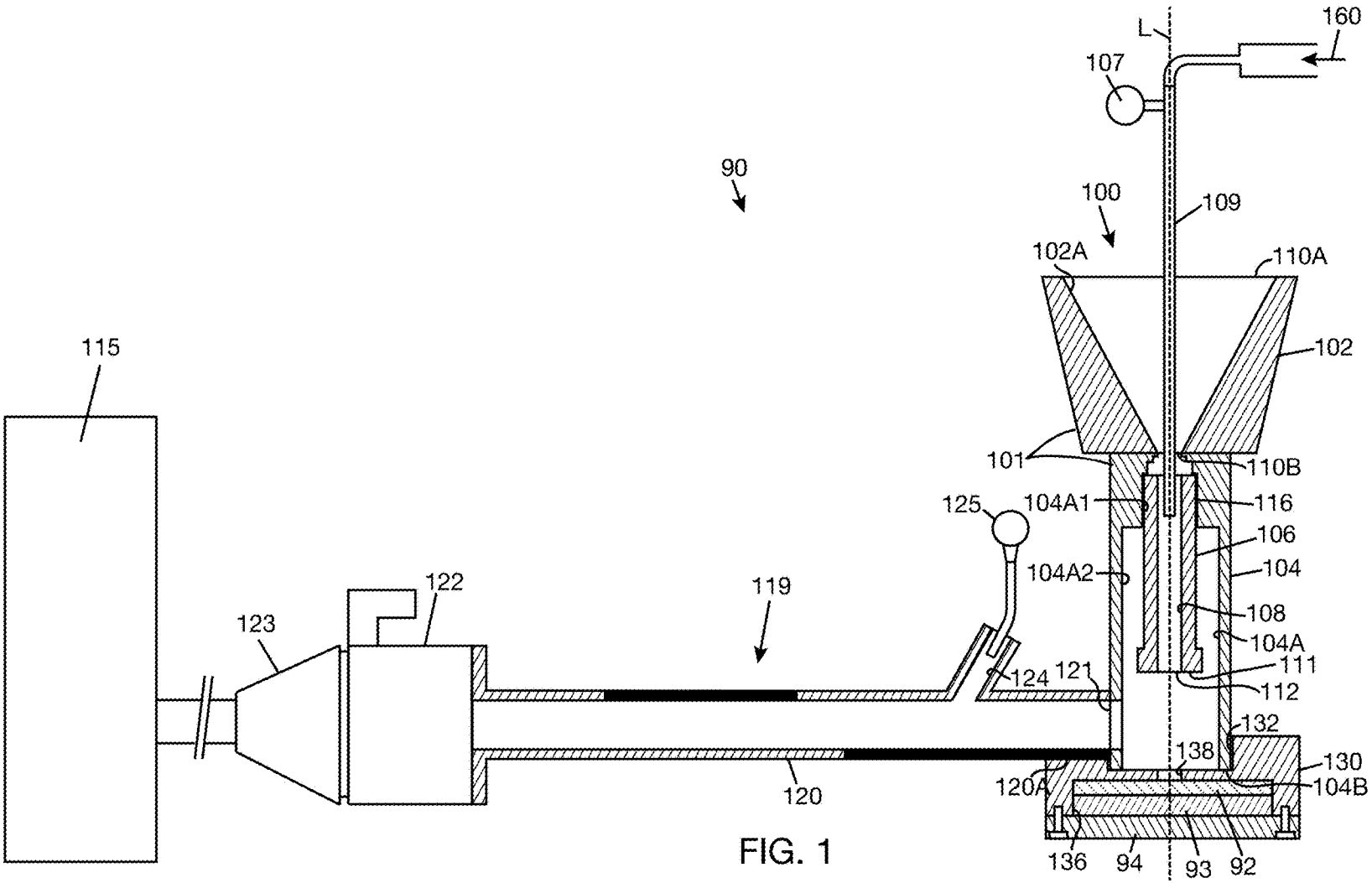
FIG. 1 shows an abrading device according to one illustrative embodiment.

FIG. 1 shows an abrading device 90 including a funnel assembly 100. The funnel assembly 100 may be used to deliver abrasive material to a specimen, e.g., specimen 92, during an abrasion procedure. Standard abrasion procedures for glass materials are described in Section A2 of ASTM C158-02. In general, the abrasive material will be in loose granular form. Typically, the abrasive material will be a hard material, for example, silicon carbide or the like. In one embodiment, the funnel assembly 100 includes an orifice structure disposed within a funnel. The orifice structure provides an outlet orifice within the funnel. The position of the orifice structure within the funnel is adjustable such that a distance between the outlet orifice and the bottom end of the funnel is adjustable. When such a funnel assembly is used in an abrasion procedure and the positions of the funnel and specimen are fixed, it would be possible to change the abrasion distance for the abrasion procedure. As used herein, the term "outlet orifice" will refer to the smallest internal diameter opening along the flow path (or longitudinal axis) of the funnel that is closest to the bottom end of the funnel. As used herein, the term "abrasion distance" is the distance between the outlet orifice and the specimen to be abraded.

In one embodiment, as shown in FIG. 1, the funnel assembly 100 includes a funnel 101 having a funnel mouth 102 with a bore 102A and a funnel stem 104 with a bore 104A. The bore 102A of the funnel mouth 102 has a frusto-conical shape starting in a wide opening 110A (at the top end of the funnel 101) and ending in a narrow opening 110B (at the top end of the funnel stem 104). The bore 104A is aligned with and in communication with the bore 102A of the funnel mouth 102. The bore 104A has a small diameter section 104A1 and a large diameter section 104A2. In one embodiment, an orifice structure, which in the example of FIG. 1 is a plug 106, may be arranged inside the bore 104A of the funnel stem 104 to provide the funnel assembly 100 with an outlet orifice 112 whose position is adjustable relative to a bottom end 104B of the funnel stem 104 (the bottom end of the funnel stem 104 is also the bottom end of the funnel 101).

Figure 2A:
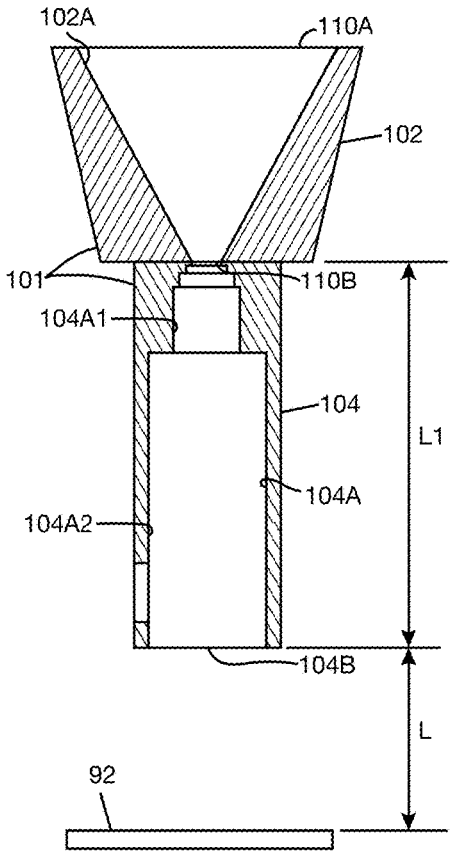
FIG. 2A shows a funnel without an orifice structure.
Figure 2B:
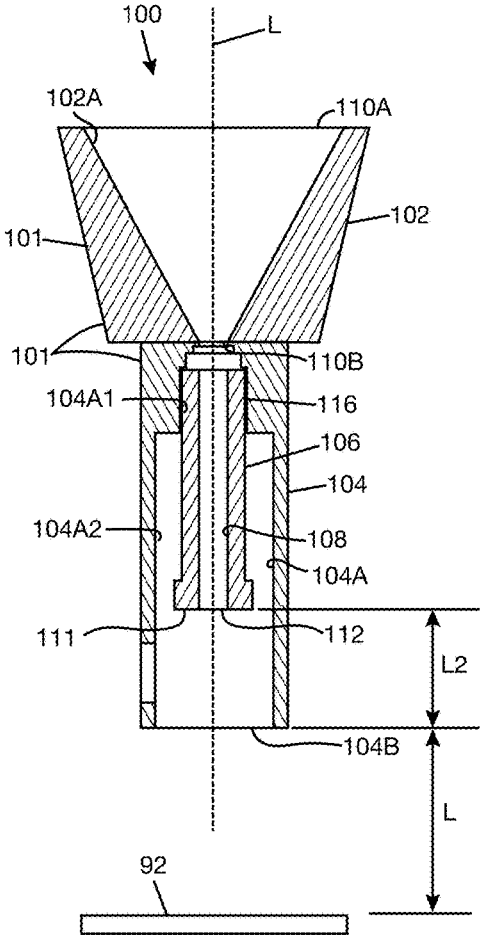
FIG. 2B shows a funnel with a plug-type orifice structure.

For comparison purposes, FIG. 2A shows the funnel 101 without an internal orifice structure. In FIG. 2A, the smallest internal diameter of the funnel 101 is located at the funnel mouth narrow opening 110B. For the funnel 101 without the internal orifice structure as shown in FIG. 2A, the funnel mouth narrow opening 110B will be the outlet orifice. FIG. 2B shows the funnel 101 with the plug 106, which is an example of an orifice structure, disposed inside the bore 104A of the funnel stem 104. The plug 106 has a through-bore 108 and is arranged inside the bore 104A of the funnel stem 104 such that the through-bore 108 is aligned with the funnel mouth narrow opening 110B, which would allow abrasive material dumped into the funnel mouth 102, through the funnel mouth wide opening 110A, to flow into the through-bore 108. The through-bore 108 provides an opening 112 at a distal end 111 of the plug 106. The diameter of the opening 112 may be the same as or smaller than the diameter of the funnel mouth narrow opening 110B, which would allow the opening 112 to effectively become the outlet orifice of the funnel assembly 100. During an abrasion procedure, an air tube of a select diameter (109 in FIG. 1) may be inserted into the through-bore 108 through the funnel mouth 102. Therefore, the diameter of the through-bore 108 should be large enough to accommodate the air tube while allowing flow of abrasive material around the air tube to the plug opening 112.

The plug 106, when disposed in the bore 104A of the funnel stem 104 as described above, effectively moves the location of the outlet orifice of the funnel assembly 100 from the funnel mouth narrow opening 110B to the plug opening 112. One way of visualizing the effect of the plug 106 is to compare the outlet orifice offset distances L1 and L2 shown in FIGS. 2A and 2B, respectively. The outlet orifice offset distances are the distances between the outlet orifices and the bottom end 104B of the funnel stem 104/funnel 101. For illustration purposes, FIGS. 2A and 2B also show a specimen 92 located at a distance L from the bottom end 104B of the funnel stem 104/funnel 101. For the funnel 101 shown in FIG. 2A without the internal orifice structure, the abrasion distance will be L1+L. For the funnel assembly 100 shown in FIG. 2B with the orifice structure within the funnel 101, the abrasion distance will be L2+L.

In one embodiment, the outlet orifice offset distance (L2 in FIG. 2B) is adjustable. In one embodiment, this adjustment is achieved by providing the reduced diameter bore section 104A1 of the funnel stem 104 with a threaded surface and the stem 116 of the plug 106 with a threaded surface. The stem 116 can be threaded into the reduced diameter bore section 104A1 of the funnel stem 104, thereby coupling the plug 106 to the funnel stem 104 and aligning the through-bore 108 with the funnel mouth narrow opening 110B. The number of turns of the threaded stem 116 into the threaded bore section 104A1 will determine the position of the plug opening (or outlet orifice) 112 along the longitudinal axis L and the value of the outlet orifice offset distance L2.

Adjustment of the outlet orifice offset distance L2 is not limited to adjusting a threaded connection between the plug 106 and the funnel stem 104. Other methods of adjusting the position of the plug 106 (or other equivalent orifice structure) along the longitudinal axis L of the funnel 101 may be used. For example, a pin and shaped slot, e.g., helical slot and the like, connection may be formed between the plug 106 and the funnel stem 104 and used to adjust the position of the plug 106 along the longitudinal axis L of the funnel 101. In general, any suitable method of adjusting the position of the plug 106 (or other equivalent orifice structure) along the longitudinal axis of the funnel 101, including use of actuators, may be used to change the outlet orifice offset distance.

It is also possible to provide a set of interchangeable orifice structures with different lengths that can be disposed, one at a time, within the funnel 101. By switching out the orifice structures, the outlet orifice offset distance L2 can be adjusted.

By adjusting the position of the outlet orifice 112 within the funnel 101 (or the length of the orifice structure within the funnel), the outlet orifice offset distance L2 can be adjusted. This would allow the abrasion distance between the outlet orifice 112 and the surface of a specimen to be controllable to generate targeted flaw introduction on a select area of the specimen without changing the position of the funnel 101 relative to the specimen. In general, the greater the distance between the outlet orifice 112 and the select area of the specimen, the less aggressive the abrading of the select area will be.

Figure 2C:
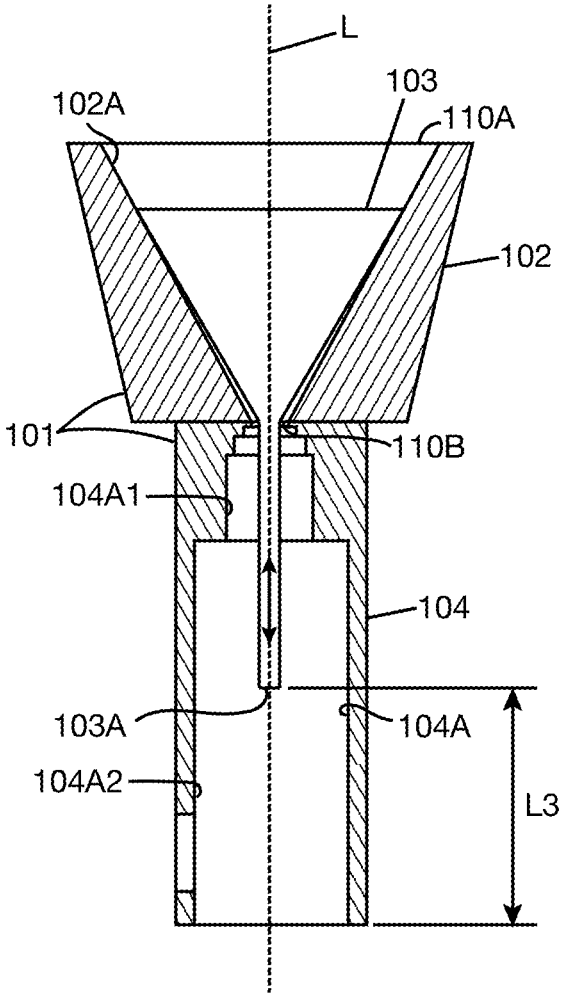
FIG. 2C shows a funnel with funnel-type orifice structure.

There are other possible orifice structures besides the plug 106 described above. Another possible orifice structure may be a funnel. For example, FIG. 2C shows use of a funnel 103 as an orifice structure. The funnel 103 is nested inside the funnel 101. The funnel stem opening 103A of the funnel 103 will provide the outlet orifice of this nested assembly. The outlet orifice offset distance is indicated at L3. The outlet orifice offset distance can be adjusted by moving the funnel 103 along the longitudinal axis of the funnel 101.

In general, any orifice structure can be disposed within the funnel 101 in a manner that would allow the position of the orifice structure to be adjustable in order to provide the funnel assembly 100 with an adjustable outlet orifice offset distance.

Returning to FIG. 1, in one embodiment, the abrading device 90 further includes a vacuum line 119 for removing spent abrasive material from the funnel 101 during or after an abrasion procedure. In one embodiment, the vacuum line 119 includes an exhaust tube 120 having an inlet end that may be connected to an opening 121 in the wall of the funnel stem 104. The opening 121 is connected to the bore 104A/large diameter bore section 104A1 of the funnel stem 104. The outlet end of the exhaust tube 120 may be connected to a vacuum pump 115 through a valve 122. A connector 123 at the end of the valve 122 may enable such connection to the vacuum pump 115. The valve 122 may be a ball valve or other type of controllable valve. The vacuum pump 115 can enable effective removal of spent abrasive material from the funnel stem 104 through the exhaust tube 120. One or more metering ports 124 may be provided at various locations along the exhaust tube 120. A gage 125 may be in communication with each port 124 to measure a condition inside the exhaust tube 120. In one embodiment, a vacuum gage 125 is used to measure the vacuum pressure inside the exhaust tube 120. The measurements may be made proximate the opening 121 of the funnel stem 104 as shown. The measurements may be used to adjust operation of the vacuum pump, which would affect the rate at which spent abrasion material is drawn from the funnel 101 through the exhaust tube 120. Although not shown, it is possible to arrange for a controller to receive the output of the gage 125. The controller may send or display appropriate signals to adjust the valve 122 in response to the output of the gage 125.

Figure 3A:
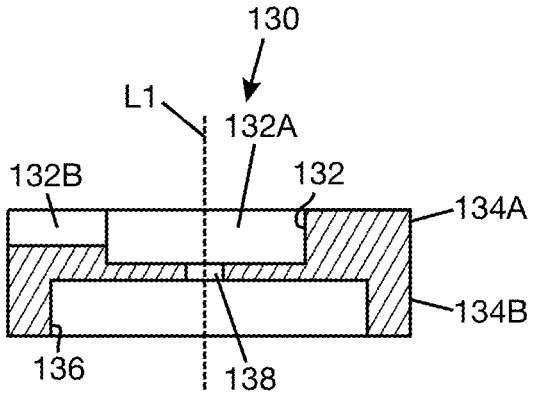
FIG. 3A shows a fixture for exposing a surface of a specimen to a funnel assembly outlet orifice.
Figure 3B:
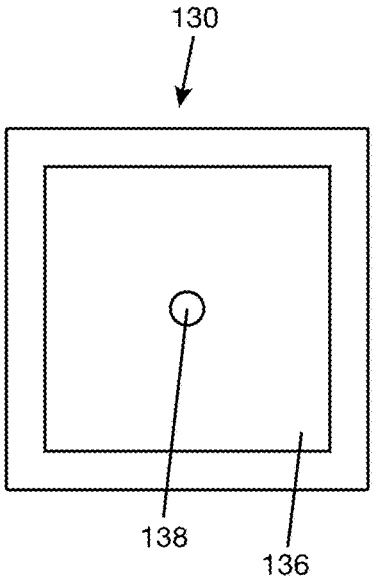
FIG. 3B is a bottom view of the fixture of FIG. 3A.
Figure 3C:
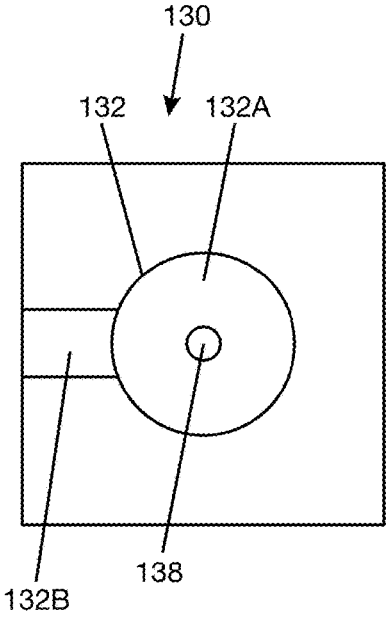
FIG. 3C is a top view of the fixture of FIG. 3A.

In one embodiment, the abrading device 90 includes a fixture 130 that may be used to expose a surface of a specimen to the outlet orifice 112 of the funnel assembly 100. Referring to FIGS. 3A-3C, in one embodiment, an upper receptacle 132 is formed in an upper body portion 134A of the fixture 130. A central part 132A of the upper receptacle 132 is shaped to receive a bottom portion (104B in FIG. 1) of the funnel stem, and a lateral part 132B of the upper receptacle 132 is shaped to receive a bottom portion (120A in FIG. 1) of the exhaust tube. The upper receptacle 132 will allow the funnel (101 in FIG. 1) and exhaust tube (120 in FIG. 1) to sit in the upper body portion 134 of the fixture 130. A lower receptacle 136 is formed in a lower body portion 134B of the fixture 130. A hole (or passage) 138 formed in the fixture 130 connects the lower receptacle 136 to the upper receptacle 132. The lower receptacle 136 is shaped to receive a specimen such that a surface of the specimen is exposed to the hole 138. The lower receptacle 136 may have a square shape for a square specimen or a non-square shape for a non-square specimen. The central part 132A, the hole 138, and the lower receptacle 136 may be aligned along a longitudinal axis L1 of the fixture 130.

As shown in FIG. 1, when the funnel 101 and exhaust tube 120 sit in the upper receptacle 132, the hole 138 will be aligned with the outlet orifice 112 (also, the longitudinal axis L1, in FIG. 3A, of the fixture 130 will the aligned with the longitudinal axis L of the funnel 101), thereby exposing a surface of a specimen, e.g., specimen 92, disposed within the lower receptacle 136 to the outlet orifice 112. During an abrasion procedure, the specimen 92 may be pressed against the hole 138 using a plate 93 that fits into the lower receptacle 136. This will allow the abrasion area on the specimen 92 to be limited to a size defined by the hole 138. Also, this will prevent or limit flexing of the specimen 92 during the abrasion procedure. A bolted plate 94 or other suitable means may be used to hold the plate 93 in place against the specimen 92.

Figure 4A:
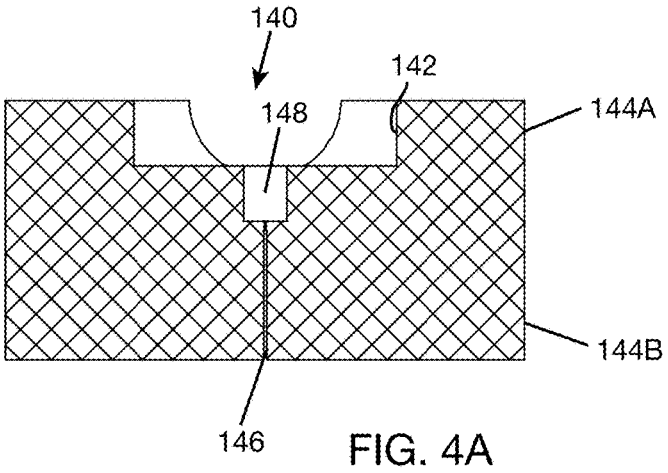
FIG. 4A shows a fixture for exposing an edge of a specimen to a funnel assembly outlet orifice.
Figure 4B:
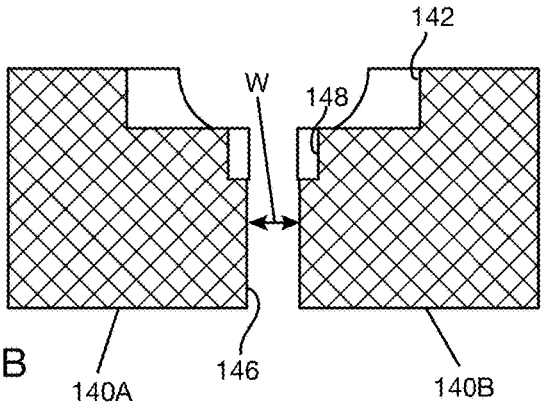
FIG. 4B shows the fixture of FIG. 4A in halves.

FIG. 4A shows a fixture 140 that may be used to expose an edge of a specimen to the outlet orifice 112. As in the case of the surface fixture (130 in FIGS. 3A-3C), an upper receptacle 142 is formed in an upper body portion 144A of the fixture 140. The upper receptacle 142 is shaped to receive bottom portions (104B, 120A in FIG. 1) of the lower funnel part and exhaust tube. A lower receptacle 146 is formed in a lower body portion 144B of the fixture 140. A hole 148 connects the lower receptacle 146 to the upper receptacle 142. The lower receptacle 146 is in the form of a slit and is sized to receive an edge of a specimen such that the edge is exposed to the hole 148. The edge fixture 140 may be formed in two halves, as shown at 140A, 140B in FIG. 3B, and the spacing, W in FIG. 3B, between the two halves may be used to control the width of the receptacle 146. The two fixture halves may be coupled together using any suitable method, such as dowel pins in one half that fits into holes in the other half. The edge fixture 140 will be used in the same manner described above for the surface fixture (130 in FIG. 1) and will allow the abrasive material from the outlet orifice (112 in FIG. 1) to be restricted to the edge of the specimen during an abrasion procedure, which would avoid scratching of the surfaces of the specimen during the procedure or obviate the need to apply masks to the surfaces of the specimen before the procedure.

The fixtures 130, 140 described above will allow consistent delivery of abrasive material to different specimens during abrasion procedures, thereby enabling more reliable mechanical testing and comparison of the abrasion strengths of the specimens.

The abrading device 90 described above can be used in abrasion procedures as described in ASTM C158-A2. Referring to FIG. 1, in general, an abrasion procedure involves placing a specimen, e.g., specimen 92, below the funnel assembly 100 using a suitable fixture, e.g., fixture 130 if surface abrasion is desired. If necessary, the outlet orifice offset distance (L2 in FIG. 2B) may be adjusted, as explained above, to set the abrasion distance (distance between the outlet orifice 112 and the specimen 92) to a select value. After the abrasion distance is set to the select value, gas flow is established through the funnel 101. This involves supplying air, or other inert gas (for glass materials, this may be nitrogen, for example), into the air tube 109 that is inserted into the funnel 101, as indicated by the arrow 160. The gas will pass through the orifice structure, e.g., plug 106, within the funnel 101, exiting through the outlet orifice 112 into the bore 104A of the funnel stem 104. The pressure of the gas flow in the air tube 109 may be measured, e.g., by the pressure gage 107, and used to calibrate the gas flow. Typically, the pressure of the gas flow will be about 5 psi, although the pressure may be suitably selected based on the desired abrasion of the specimen. After the gas flow is established, a measured amount of abrasive material is dumped into the funnel mouth 102. The abrasive material will flow through the funnel mouth narrow opening 110B into the orifice structure, e.g., the plug 106, and down to the outlet orifice 112, where the abrasive material will be entrained by the gas flow and carried to the specimen 92. The vacuum pump 115 can be operated to remove spent abrasive material from the funnel 101 through the exhaust tube 120. During removal of the spent abrasive material, the vacuum pressure in the exhaust tube 120, such as proximate the opening 121 in the wall of the funnel stem 104, can be monitored. If the vacuum pressure within the exhaust tube 120 is not at the desired level, the valve 122 can be operated to control the flow rate out of the exhaust tube 120. In one embodiment, the pressure in the exhaust tube 120 is controlled to about 10" $H_2O$. The process explained above can be repeated for as many specimens as desired.

Figure 5A:
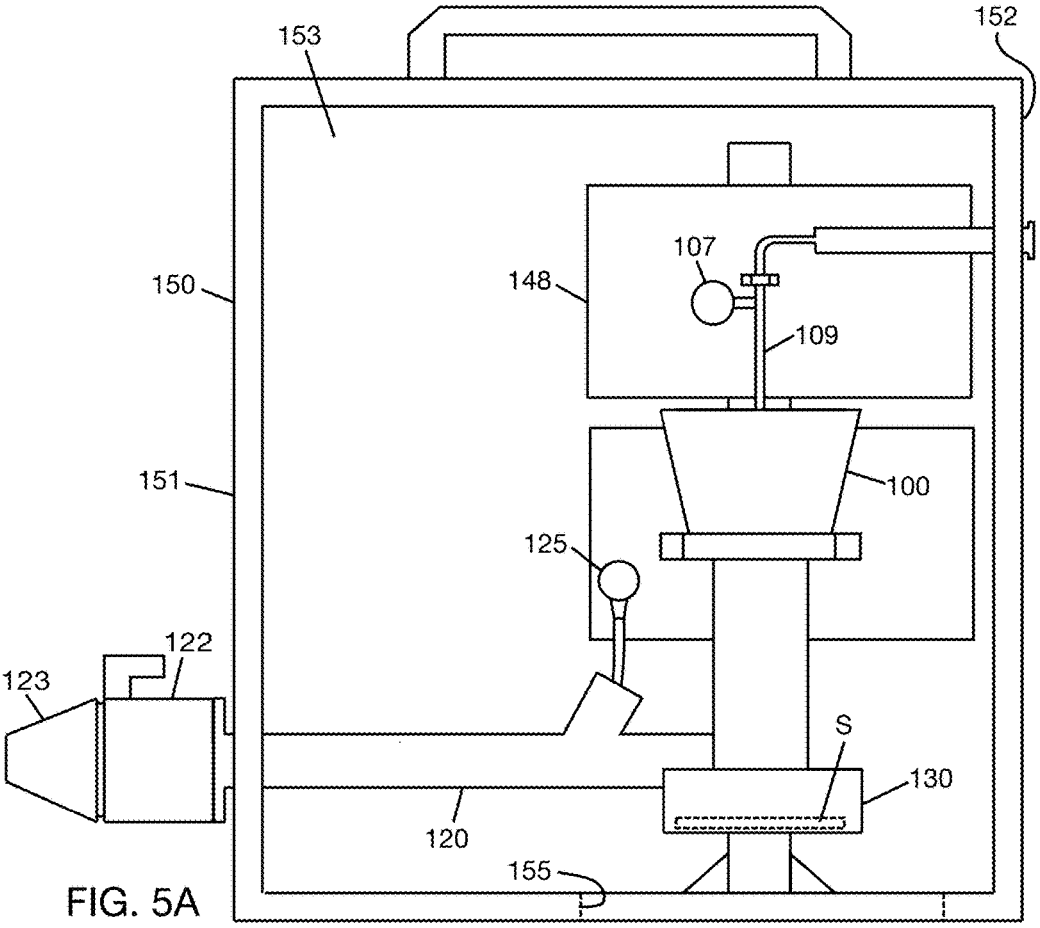
FIG. 5A shows the abrading device of FIG. 1 in a containment box.

One of the advantages of the internally adjustable outlet orifice of the funnel assembly 101 is that the abrading device 90 can be packaged for portability. As shown in FIG. 5A, the abrading device 90 may be mounted to a support 148, which can be placed in a containment box 150. The sidewall 151 of the containment box 150 may include an opening through which the valve 122 extends out for connection to a suitable vacuum pump. The vacuum pump may be as simple as a household vacuum cleaner or may be another vacuum pump suitable for use with loose granular abrasive material. In any case, the vacuum pump can be connected to the exhaust tube 120 at a suitable abrading location so that it is not necessary to make the containment box 150 large enough to hold the vacuum pump. The sidewall 152 (or other wall) of the containment box 150 may include an opening through which the air tube 109 can be connected to a pressure line. The pressure of the gas delivered to the air tube 109 will be determined by the abrasion procedure and can be monitored using the pressure gage 107.

Figure 5B:
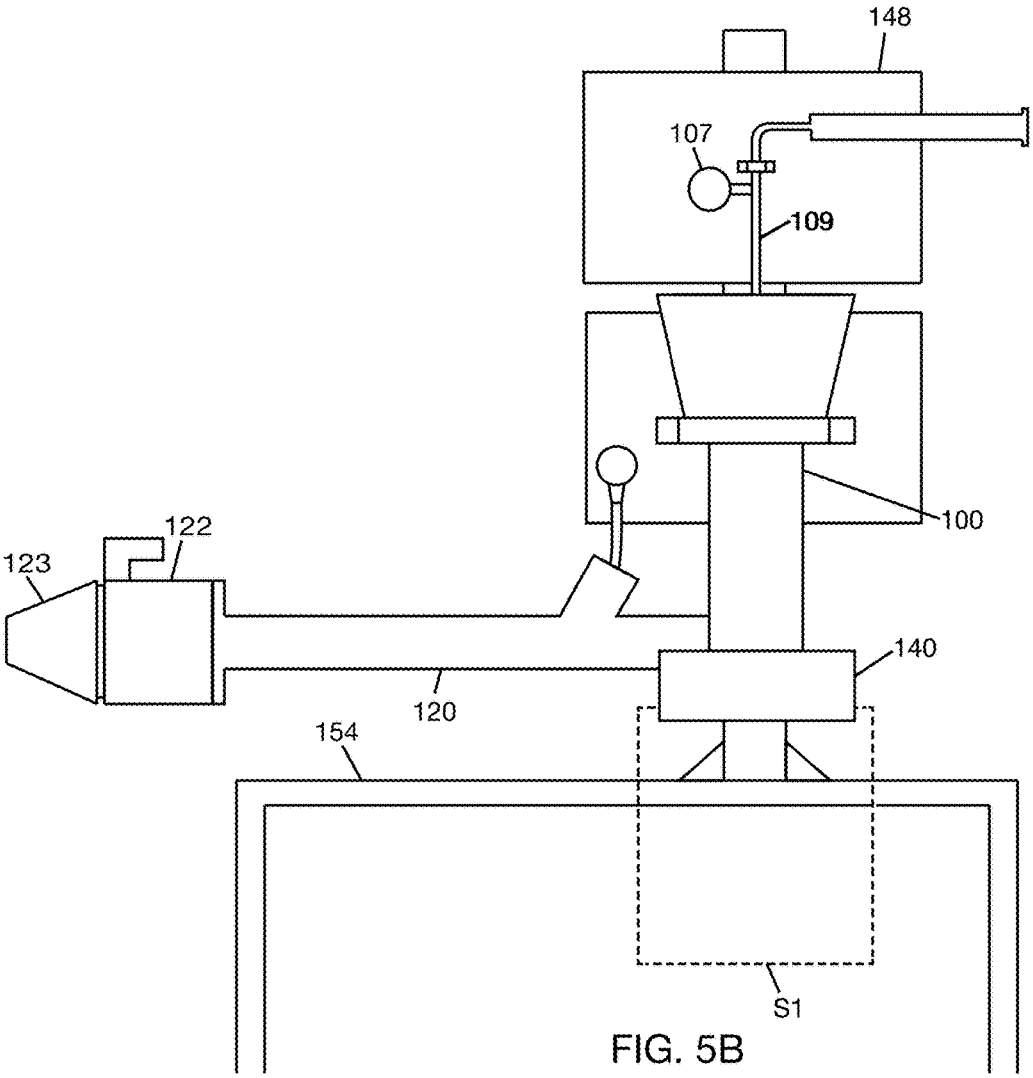
FIG. 5B shows the abrading device of FIG. 1 in a position for edge abrasion.

Other openings may be provided in the walls of the containment box as necessary to allow access to the contents of the containment box. For example, if the surface fixture 130 is being used in an abrasion procedure, as shown in FIG. 5A, an opening 155 in the bottom wall of the containment box 150 will allow a specimen S to be placed within the appropriate opening in the fixture while the funnel assembly 100 and exhaust tube 102 remain in the containment box 150, as shown in FIG. 5A. The front wall 153 of the containment box 150 may be made of a transparent material to allow viewing of the abrasion procedure. If the edge fixture 140 is being used in an abrasion procedure, the parts of the abrading device 90 that would normally be in the containment box 150 may be removed from the containment box 150, as shown in FIG. 5B, and placed on a surface 154 for ease of use and to accommodate the size of the specimen 51. The surface 154 may be provided by an outside surface of the containment box, for example, or other available surface.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An abrading device, comprising:

a funnel assembly comprising:

a funnel comprising:

a funnel mouth with a bore, wherein the funnel mouth is a top end of the funnel; and a funnel stem comprising a bore and a bottom end, wherein the bore of the funnel stem is aligned with and in communication with the bore of the funnel and the bottom end of the funnel stem is a bottom end of the funnel;

an orifice structure disposed within the bore of the funnel stem and comprising a through-bore and an outlet orifice positioned distal from the funnel mouth, the orifice structure having an adjustable position or length within the funnel such that an offset distance of the outlet orifice of the orifice structure from the bottom end of the funnel assembly is adjustable; and a vacuum line connected to the funnel stem, wherein:

abrasion material introduced into the funnel mouth passes through the bore of the funnel mouth, through the through-bore of the orifice structure, through the bore of the funnel stem, and onto a specimen positioned proximate the bottom end of the funnel thereby abrading the specimen; and spent abrasion material is removed from the funnel assembly through the vacuum line after abrading the specimen.

2. The abrading device of claim 1, wherein the vacuum line has an adjustable vacuum pressure.

3. The abrading device of claim 2, wherein the vacuum line comprises an exhaust tube connected to an opening in the funnel.

4. The abrading device of claim 3, wherein the vacuum line further comprises at least one port in the exhaust tube for measuring vacuum pressure in the exhaust tube.

5. The abrading device of claim 4, wherein the vacuum line further comprises a valve for adjusting a flow rate out of the exhaust tube.

6. The abrading device of claim 5, wherein the vacuum line further comprises a vacuum pump in communication with the exhaust tube through the valve.

7. The abrading device of claim 1, wherein the orifice structure is a plug and the through-bore extends through the plug.

8. The abrading device of claim 7, wherein the plug is coupled to the funnel stem by a threaded connection, and wherein the position of the outlet orifice is adjustable by adjusting the threaded connection.

9. The abrading device of claim 1, further comprising a fixture comprising an upper receptacle in which a bottom portion of the funnel stem is received, wherein a specimen to be abraded is disposed in the fixture.

10. The abrading device of claim 9, wherein the fixture further comprises:

a lower receptacle in which the specimen to be abraded is disposed; and a hole formed between the upper receptacle and the lower receptacle, wherein the abrasion material passes from the bore of the funnel stem into the upper receptacle and through the hole between the upper receptacle and the lower receptacle, thereby abrading the specimen disposed in the lower receptacle.

11. The abrading device of claim 10, wherein the lower receptacle is in the form of a slit adapted to receive an edge of a specimen.

* * * * *